US006270312B1

(12) United States Patent
Heer

(10) Patent No.: US 6,270,312 B1
(45) Date of Patent: Aug. 7, 2001

(54) COOLING WATER PUMP FOR AN INTERNAL COMBUSTION ENGINE

(75) Inventor: Siegfried Heer, Kirchdorf/Krems (AT)

(73) Assignee: TCG Unitech Aktiengesellschaft, Kirchdorf/Krems (AT)

( * ) Notice: Subject to any disclaimer, the term of this patent is extended or adjusted under 35 U.S.C. 154(b) by 0 days.

(21) Appl. No.: 09/559,522

(22) Filed: Apr. 28, 2000

(30) Foreign Application Priority Data

Apr. 29, 1999 (AT) ..... A773/99

(51) Int. Cl.[7] ..... F04D 29/08
(52) U.S. Cl. ..... 415/111; 415/168.2; 415/230
(58) Field of Search ..... 415/111, 112, 415/168.2, 230, 231; 123/41.44

(56) References Cited

U.S. PATENT DOCUMENTS 3,981,610 * 9/1976 Ernst et al. ..... 415/219
5,660,521 * 8/1997 Serio ..... 415/111
5,785,491 * 7/1998 Ozawa et al. ..... 415/70
5,827,041 * 10/1998 Charhut ..... 415/112
5,950,577 * 9/1999 Sasaki et al. ..... 123/41.44

FOREIGN PATENT DOCUMENTS 2846950 1/1980 (DE) .
428210 5/1991 (EP) .

* cited by examiner

*Primary Examiner*—Edward K. Look
*Assistant Examiner*—James M McAleenan
(74) *Attorney, Agent, or Firm*—Dykema Gossett PLLC

(57) ABSTRACT

The invention relates to a cooling water pump for an internal combustion engine with a housing provided with a bearing designed to support a pump shaft and with a sealing element devised to seal the bearing against a working area containing the cooling agent as well as with a leakage chamber receiving the cooling agent that oozes through the sealing element, wherein the leakage chamber is arranged in a recess of the housing and is provided with an opening to the outside, said opening being partially closed by a locking device. A particularly simple way of production is achieved by having the opening closed by a foil, preferably by a metal foil, deposited on a flange facing which is flush with a front surface of the housing.

6 Claims, 2 Drawing Sheets

16
8
6
12
3
4
7
5
9
17
11
15
14
1
10
13
2

5
1
15

COOLING WATER PUMP FOR AN INTERNAL COMBUSTION ENGINE

BACKGROUND OF THE INVENTION

The invention relates to a cooling water pump for an internal combustion engine with a housing provided with a bearing designed to support a pump shaft and with a sealing element devised to seal the bearing against a working area containing the cooling agent as well as with a leakage chamber receiving the cooling agent that oozes through the sealing element, wherein the leakage chamber is arranged in a recess of the housing and is provided with an opening to the outside, said opening being partially closed by a locking device.

Cooling water pumps in motor vehicles are exposed to relatively critical working conditions. Long rest periods and great variations in temperature are to be overcome and maintenance-free operation over a long period of time is taken for granted. In practice it proved to be almost impossible to achieve a perfectly tight sealing of the pump, i.e., the oozing of small amounts of cooling agent must always be taken into account. It is however absolutely unwanted to let this quantity of leakage run out of the pump without further ado, since this would produce the impression of a defect.

DESCRIPTION OF THE PRIOR ART

In a previous suggestion of the applicant, a leakage chamber capable of receiving a certain quantity of cooling agent is provided in order to avoid the above-mentioned disadvantages. Little by little, the cooling agent can evaporate out of this leakage chamber without leaving any visible trace of its escape.

To produce such a leakage chamber however is intricate and makes manufacture of the cooling water pump more expensive.

EP 0 428 210 A1 discloses a cooling water pump with a leakage chamber that is designed, underneath the bearing section, as a hollow. The hollow is closed by a cap and a connecting duct is provided that connects the hollow constituting the leakage chamber with its surroundings. This solution requires that the leakage chamber itself and the connecting duct be manufactured in two separate machining operations and the closure of the hollow by the cap is intricate and prone to failure.

DE 28 46 950 C discloses a similar solution with a leakage chamber designed as a blind hole that is closed by a stopper. The stopper is equipped with an overflow in order to avoid complete flooding of the leakage chamber and to prevent the cooling agent from being pressed into the pump bearing in case of a failure. In this solution, functioning is absolutely satisfactory but production is intricate.

SUMMARY OF THE INVENTION

It is an object of the present invention to permit in the simplest possible manner provision of a leakage chamber in a cooling water pump of the type mentioned above. Particularly the housing, which is in most cases configured as a cast part, shall not become more complicated and shall be easy to manufacture.

This is achieved, according to the invention by having the opening closed by a foil, preferably by a metal foil, that is deposited on a flange facing. A particularly simple way of manufacturing the leakage chamber can thus be achieved. The foil can be an aluminum foil for example, which is commercially available in various dimensions and qualities and which can easily be given any desired shape by punching. A plastic-laminated metal foil can very easily be attached to the housing by using a hot-melt adhesive or by melting it on. A foil made only of plastic can also be used.

In a preferred embodiment, the foil is glued, soldered or welded onto a flange facing encompassing the opening. A sufficiently durable connection that copes without problems with the relatively low mechanical loads can thus be maintained.

The arrangement is very space-saving when the opening is located underneath the bearing.

It is particularly advantageous when the leakage chamber communicates via a connection channel with a space between the sealing element and the bearing.

The foil can be protected from damage by having it substantially covered by a drive gear of the cooling water pump.

The figures show a preferred embodiment of the present invention.

DETAILED DESCRIPTION OF THE PREFERRED EMBODIMENTS

Figure 1:
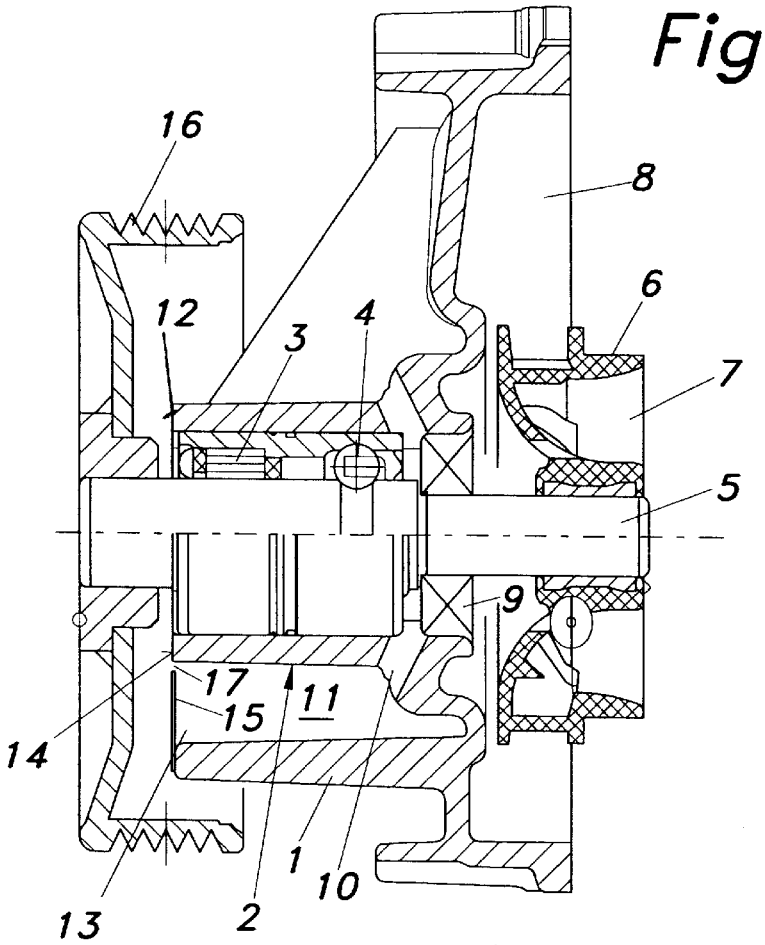
FIG. 1 is a section through a cooling water pump according to the invention.
Figure 2:
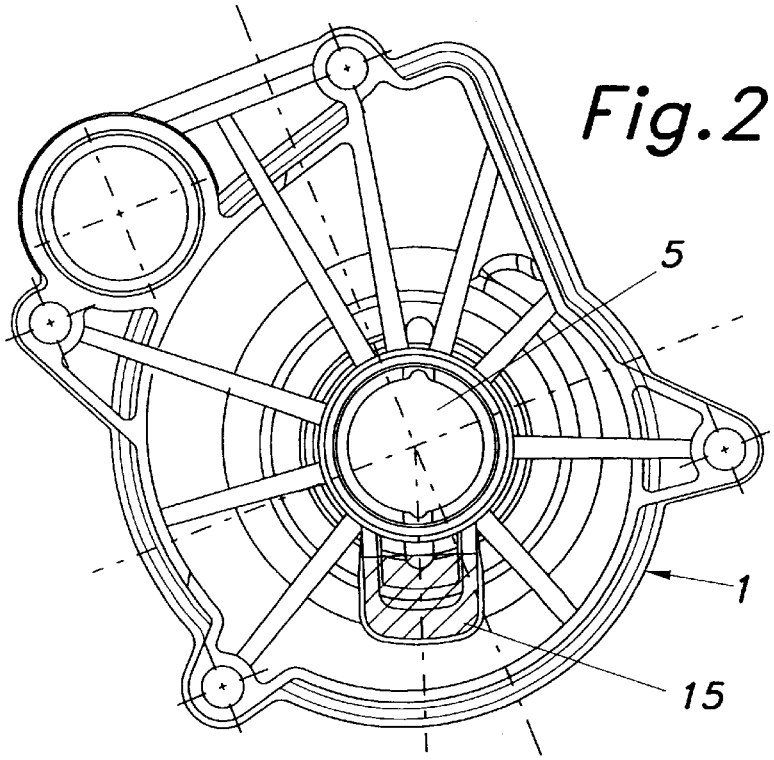
FIG. 2 is a view of the cooling water pump in axial direction and FIG. 3 is an axonometric representation.
Figure 3:
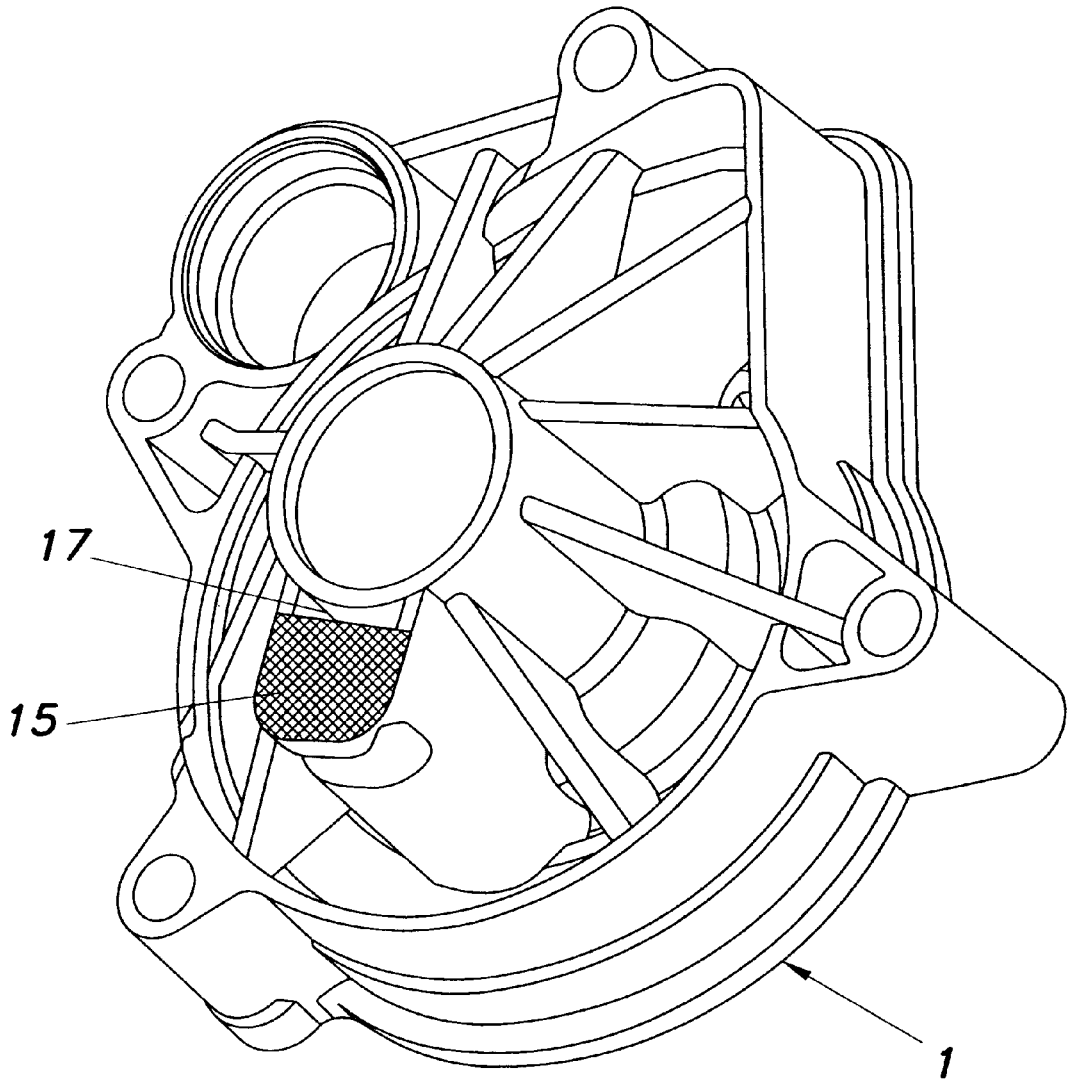

The cooling water pump of FIG. 1 consists in a housing 1 in which a bearing 2 with rolling bearings 3 and 4 is arranged, said bearings rotatably supporting a pump shaft 5. An impeller 6 is fixed on the pump shaft 5 in the known way. The impeller 6 draws a cooling agent, like for example cooling water, in an aspiration area 7 and throws it in radial direction into a pump chamber 8 that is configured in the housing 1. The pump chamber 8 is closed by a cover which is not illustrated in the drawings herein, said cover being arranged on the housing 1.

A sealing element 9 is provided between the housing 1 and the pump shaft 5 and is designed to seal the cooling agent, said sealing element 9 being configured as a rotating mechanical seal for example. Thanks to this sealing element, the cooling agent can be hindered from getting from the pump chamber 8 to the rolling bearings 3, 4 and from there to the outside. In the housing 1, a connection channel 10 directed downward is arranged between the sealing element 9 and the first rolling bearing 4 , said channel leading to a leakage chamber 11 that is also arranged in the housing 1. This leakage chamber 11 can receive a predetermined quantity of cooling agent. On the front side 12 of the housing, the leakage chamber 11 is provided with an opening 13, which is surrounded by a flange facing 14. A metal foil 15, which almost completely closes the opening 13, is glued onto the flange facing 14. The metal foil 15 can be an aluminum foil 0,8 mm thick that is soldered onto the flange facing 14. The opening 13 can be made easily while the housing 1 is being cast. To deposit the metal foil 15 is an operating process that can be automated easily.

The flange facing 14 of the housing 1 is covered, together with the front area 12, by a drive gear 16 rigidly connected to the pump shaft 5. The metal foil 15 is thus also covered, so that it is almost impossible that it gets damaged during operation.

The cooling agent collected in the leakage chamber 11 is hindered from oozing by the metal foil 15 and can evaporate after having been heated up by the heat of the bearings, wherein the vapor can exit through the area 17 which is not covered by the metal foil 15.

The present invention permits to produce a cooling water pump according to a simplified procedure and thus to provide a reasonably priced cooling water pump.

I claim:

1. A cooling water pump for an internal combustion engine with a housing provided with a bearing designed to support a pump shaft and with a sealing element devised to seal the bearing against a working area containing the cooling agent as well as with a leakage chamber receiving the cooling agent that oozes through the sealing element, wherein the leakage chamber is arranged in a recess of the housing and is provided with an opening to the outside, said opening being partially closed by a foil, deposited on a flange facing which is flush with a front surface of the housing.

2. A cooling water pump according to claim 1, wherein the foil is glued, soldered or welded onto a flange facing encompassing the opening.

3. A cooling water pump according to claim 1, wherein the opening is located underneath the bearing.

4. A cooling water pump according to claim 1, wherein the leakage chamber communicates via a connection channel with a space between the sealing element and the bearing.

5. A cooling water pump according to claim 1, wherein the foil is substantially covered by a drive gear of the cooling water pump.

6. A cooling water pump according to claim 1, wherein the foil is made of metal.

* * * * *